US006361282B1

(12) United States Patent
Wanschura

(10) Patent No.: US 6,361,282 B1
(45) Date of Patent: Mar. 26, 2002

(54) DUAL PUMP UNIT

(75) Inventor: Günter Wanschura, Ulm (DE)

(73) Assignee: Brueninghaus Hydromatik GmbH (DE)

( * ) Notice: Subject to any disclaimer, the term of this patent is extended or adjusted under 35 U.S.C. 154(b) by 0 days.

(21) Appl. No.: 09/554,647

(22) PCT Filed: Jun. 22, 1999

(86) PCT No.: PCT/EP99/04303

§ 371 Date: May 17, 2000

§ 102(e) Date: May 17, 2000

(87) PCT Pub. No.: WO99/67532

PCT Pub. Date: Dec. 29, 1999

(30) Foreign Application Priority Data

Jun. 24, 1998 (DE) ..... 198 28 108

(51) Int. Cl.[7] ..... F04B 23/12; F04B 27/08

(52) U.S. Cl. ..... 417/206; 417/269; 92/71

(58) Field of Search ..... 417/269, 205, 417/206, 244, 254; 92/71; 91/502

(56) References Cited

U.S. PATENT DOCUMENTS

| | | | | | |
|---|---|---|---|---|---|
| 1,539,616 | A | * | 5/1925 | Williams | 417/269 |
| 4,534,271 | A | * | 8/1985 | Foprster | 91/472 |
| 5,247,794 | A | * | 9/1993 | Benson et al. | 60/487 |
| 5,800,134 | A | * | 9/1998 | Hasegawa et al. | 417/269 |

FOREIGN PATENT DOCUMENTS

| | | | |
|---|---|---|---|
| DE | 19 37 347 | A | 2/1971 |
| DE | 19 37 347 | | 2/1971 |
| DE | 23 32 584 | A1 | 1/1975 |
| DE | 23 32584 | A | 1/1975 |
| DE | 26 52 231 | A1 | 5/1978 |
| DE | 26 52 231 | A | 5/1978 |
| DE | 33 24 583 | A1 | 1/1984 |
| DE | 32 38 362 | A1 | 4/1984 |
| DE | 32 38 362 | A1 | 4/1984 |
| DE | 33 24 583 | A | 1/1987 |
| DE | 42 25380 | A1 | 2/1994 |
| DE | 42 52 381 | A1 | 2/1994 |
| DE | 37 16 347 | C2 | 2/1995 |
| DE | 37 16 374 | C2 | 2/1995 |
| DE | 195 36 997 | C1 | 2/1997 |
| DE | 195 36 997 | C1 | 2/1997 |
| EP | 590 20 576 | | 2/1984 |
| JP | 57 128875 | | 2/1984 |

* cited by examiner

*Primary Examiner*—Charles G. Freay
(74) *Attorney, Agent, or Firm*—Scully, Scott, Murphy & Presser

(57) ABSTRACT

A dual pump unit comprising two hydraulic pumps (2,3) with coaxially mounted drive shafts (4,5) that are coupled to each other in a non-positive fit by means of a coupling member (28). The coupling member (28) surrounds a connecting member (15), wherein high pressure lines (29,30) and low pressure lines (31,32) are formed. The connecting member (15) extends between two control bodies (33) that are respectively associated with one hydraulic pump (2,3) and which are used to create a cyclic connection between the cylinders (18,19) of the hydraulic pumps (2,3) and the high pressure lines (29,30) and low pressure lines (31,32). The connecting member (15) consists of two connector plates (13,14) defining one of the hydraulic pumps (2,3) respectively on the control bodies (33,43) and an individually formed interchangeable intermediate element (38) arranged between the connector plates (13,14). The connector plates (13,14) each have a recess (34,35) into which the intermediate element (38) can be respectively inserted so that the connector plates (13) can radially encompass the intermediate element (38) and the intermediate element (38) can be fixed between the connector plates (13,14).

9 Claims, 2 Drawing Sheets

DUAL PUMP UNIT

This is a national stage application under 35 U.S.C. §371 of application Ser. No. PCT/EP99/04303, filed in Germany under the Patent Cooperation Treaty, and having an International Priority Date of Jun. 22, 1999.

The invention relates to a dual pump unit for connecting two hydraulic pumps. The hydraulic pumps operate either as so-called tandem pumps with the same volumetric delivery or as so-called contact pumps with different volumetric deliveries.

A dual pump unit is known from DE 195 36 997 C1, in which two axially disposed drive shafts of two hydraulic pumps are non-positively coupled together by means of a coupling piece. High-pressure lines and low-pressure lines are formed in a connecting piece surrounding the coupling piece in order to supply the cylinders of the hydraulic pumps cyclically with the high pressure and the low pressure via a respective control body. This publication also discloses the integration of a booster pump into the connecting piece in order to obtain a higher degree of pre-compression in the low-pressure line.

Connections between hydraulic pumps of different designs can be found, for example, in DE 32 38 362 A1, DE 42 25 380 A1 and DE 37 16 374 C2.

A disadvantage of the known dual pump units lies in the fact that the connecting member between the two hydraulic pumps is of a rigid structure and cannot be flexibly adapted to different conditions. Thus in practice there is on the one hand, for example, the need to connect two hydraulic pumps together by a simply formed connecting piece as inexpensively as possible, whereas, for example, other dual pump units require the integration of a booster pump, for example in the form of a gear pump, into the connecting piece without this greatly increasing the expenditure in construction terms. It has therefore been necessary until now for the intermediate pieces to be of a different basic construction for these different purposes, without being able to resort to common construction elements.

The object of the invention is therefore to provide a dual pump unit which, starting out from a basic construction, can easily be adapted to different configurations.

In this respect the invention is based on the recognition that the same basic elements can be returned to for all configurations as a result of dividing the connecting piece into two connection plates, each constructed in the same way for all configurations, and into an intermediate element which is disposed between the connection plates, is interchangeable and can be configured individually. Here the connection plates each comprise a recess in which the respective intermediate element can be at least partly inserted, so that the connection plates at least partly encompass the intermediate element radially and the intermediate element is thus fixed between the connection plates. The connection plates are at the same time radially centered by means of the intermediate element. The radial centering of the connection plates is essential for exact coaxial alignment of the drive shafts of the hydraulic pumps.

The intermediate element can be formed, for example, in a simple manner as a discoid cylindrical body. In this case the recesses in the connection plates are also cylindrical and their diameter corresponds to that of the intermediate element. The two connection plates and thus the two drive shafts are therefore exactly centered by inserting the intermediate element in the recesses in the connection plate. This formation of the intermediate element entails an extremely low cost and is suitable for hydraulic pump units in which the hydraulic pumps only have to be mechanically and hydraulically connected together, without a booster pump having to be integrated into the connecting piece.

The connection plates can be screwed together in a radially outer region. The intermediate element can comprise at least one ring channel, so that different arrangements of the individual ports are possible.

A booster pump in the form of a gear pump, for example, can be integrated into the intermediate piece. The intermediate element is then divided into a main body and an insert body, which is inserted in a recess in the main body and holds the booster pump. The main body forms a first axial projection and the insert body a second axial projection, each of which projections engage in a recess in the two connection plates. The overall result of this is likewise centering of the two connection plates by means of their recesses and the intermediate element disposed in between. It is in this respect also advantageous here if the recesses in the connection plate and the main body are cylindrical and have the same diameter. A low-pressure port and a connection from the booster pump to a first ring channel, which adjoins the connection plates, is integrated into the main body. A connection from the booster pump to a second ring channel, which adjoins the other connection plate, is integrated into the insert body. The ring channels guarantee a flexible connection to the low-pressure ports in the respective adjoining connection plates. The connection plates and the main body can then be screwed together in a region radially surrounding the insert body.

An embodiment is described in detail in the following with reference to the drawings, in which:

FIG. 1 shows an embodiment of the dual pump unit 1 according to the invention in an axial longitudinal section, this being a first configuration of this dual pump unit 1.

Figure 1:
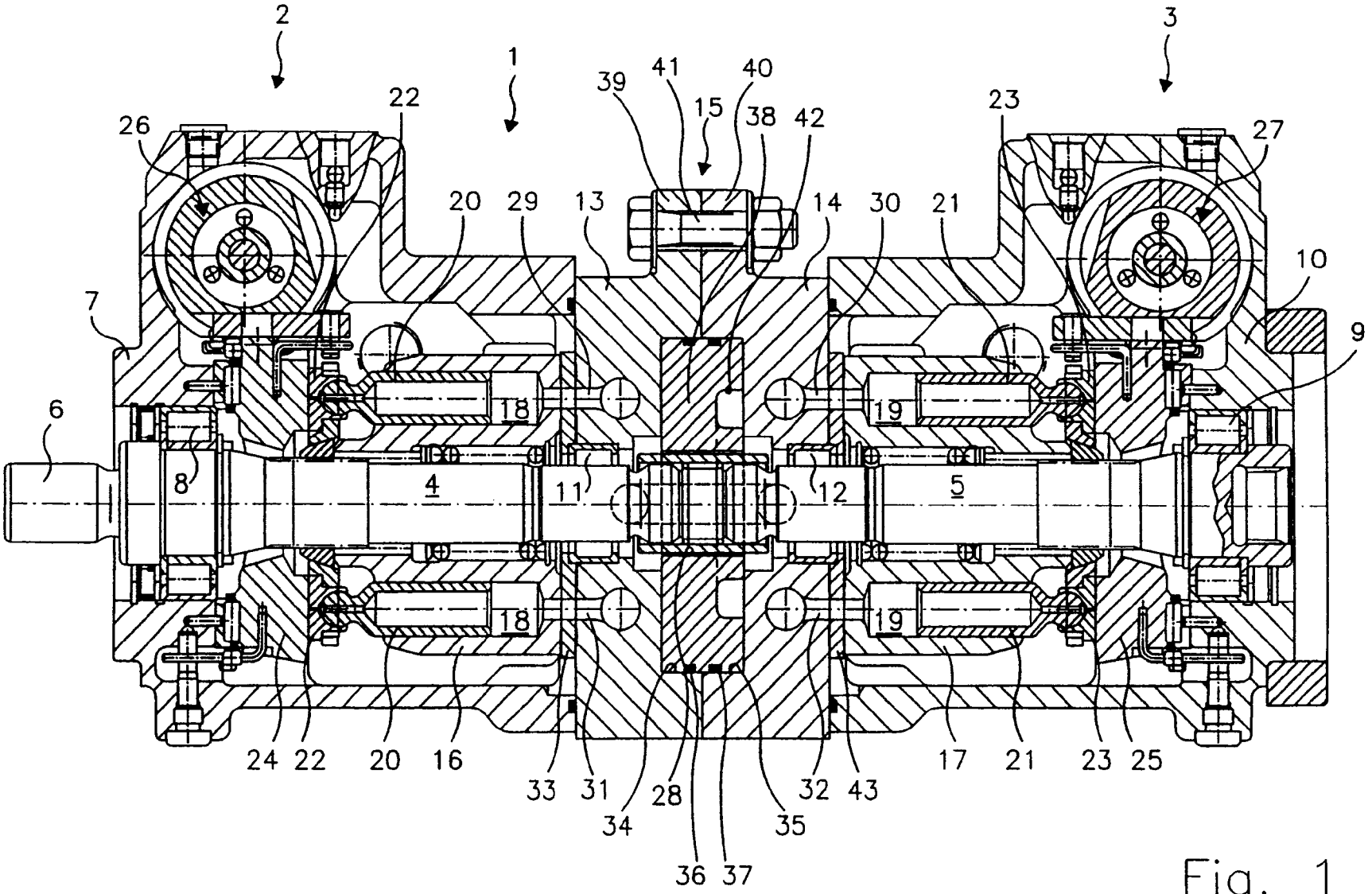
FIG. 1 is an axial section through an embodiment of a dual pump unit according to the invention in a first configuration.

The dual pump unit consists of two hydraulic pumps 2 and 3, which are of swash plate design in the represented embodiment. The hydraulic pumps 2 and 3 each comprise a drive shaft 4 and 5, which are aligned coaxially with one another. The drive shaft 4 of the hydraulic pump 2 on the left in FIG. 1 is extended out of the casing 7 by means of a drive journal 6, so that the two hydraulic pumps 2 and 3 can be jointly driven. The drive shafts 4 and 5 are mounted via a first rolling contact bearing 8 or 9 in the casing 7 or 10 of the respective hydraulic pump 2 or 3 and via a second rolling contact bearing 11 or 12 in a first connection plate 13 or a second connection plate 14 of a connecting piece 15 yet to be described in detail.

A cylinder barrel 16 or 17 is connected to the respective drive shaft 4 or 5 to rotate with the latter, which barrels comprise cylinder bores 18 and 19 in which pistons 20 and 21 can move axially. The pistons 20 and 21 are supported via sliding blocks 22 and 23 at a rocker 24 or 25, which serves as a swash plate and is pivotably mounted in the casing 7 or 10. A respective adjusting device 26 or 27 serves to adjust the rocker 24 or 25. The stroke of the pistons 20 and 21 and thus the volumetric delivery of the hydraulic pump 2 or 3 can be adjusted by pivoting the rocker 24 or 25.

A coupling piece 28, which is non-positively connected to the shafts 4 and 5, for example by a tongue-and-groove joint, serves to connect the two drive shafts 4 and 5 of the hydraulic pumps 2 and 3. Thus the drive shaft 5 of the second hydraulic pump 3 is also driven via the drive journal 6 in addition to the drive shaft 4 of the first hydraulic pump 2 by way of the coupling piece 28. High-pressure lines 29 and 30 and low-pressure lines 31 and 32 are integrated into the connection plates 13 and 14. The cylinders 18 and 19 are cyclically connected to the respective high-pressure line 29 or 30 and the respective low-pressure line 31 or 32 each time the cylinder barrel 16 or 17 rotates via control bodies 33 and 43 adjoining the associated connection plate 13 or 14. The line 31 or 32 can also carry high pressure and the line 29 or 30 low pressure according to the direction of rotation and adjustment of the rocker 24 or 25.

According to the invention the first connection plate 13 comprises a recess 34 and the second connection plate 14 a recess 35, in which recesses an intermediate element 38 can be inserted. The intermediate element 38 is sealed by means of seals 36 and 37. In the represented embodiment the intermediate element 38 is formed as a discoid cylindrical body and is completely held by the two recesses 34 and 35, which are likewise cylindrical, in the connection plates 13 and 14. Here the connection plates 13 and 14 encompass the intermediate element 38 radially, so that the intermediate element 38 is fixed between the connection plates 13 and 14. The connection plates 13 and 14 are screwed together in a region 39 or 40 radially encompassing the intermediate element 38 by, preferably by a plurality of screws 41 distributed over the circumference.

It is essential for the intermediate element 38 to be interchangeable after the screws 41 have been loosened. The intermediate element 38 may be individually configured according to the requirements of the special hydraulic pump unit 1. In the configuration represented in FIG. 1 the intermediate element 38 is formed in a particularly simple fashion and can therefore be produced at a low cost. This configuration of the intermediate element 38 enables the two hydraulic pumps 2 and 3 to be easily connected mechanically and hydraulically, especially in cases in which it is unnecessary to provide a booster pump to increase the intake pressure. Here the connection plates 13 and 14 are centred with respect to one another by the intermediate piece 38, resulting in exact coaxial alignment of the drive shafts 4 and 5.

In the embodiment represented in FIG. 1 the intermediate element 38 is provided with a ring channel 42. In this case the intermediate element 38 simultaneously serves to supply the two hydraulic pumps 2 and 3 with the low pressure. The connection between the low-pressure ports 31 and 32 and the ring channel 42 delivering the low pressure may be effected at any desired point, so that a high level of flexibility in the arrangement of the ports is guaranteed.

The connection plates 13 and 14 of the two hydraulic pumps 2 and 3 are preferably identical and may also be turned through 180° when mounted at the casings 7 and 10 of the hydraulic pumps 2 and 3. This enables the high-pressure lines 29 and 30 and low-pressure lines 31 and 32 to be disposed such that they can be changed over by turning the connection plates 13 and 14. This flexibility in terms of mounting is particularly important if the connection plates 13 and 14 are designed for different flow directions. It is to be emphasized that this flexibility is basically non-existent in the case of connecting pieces known from the prior art, the connection plates 13 and 14 of which are integrally connected together.

Valves which are not represented in the drawing, in particular pressure-relief valves as a safeguard against high-pressure, or control valves may additionally be integrated into the connection plates 13 and 14.

Figure 2:
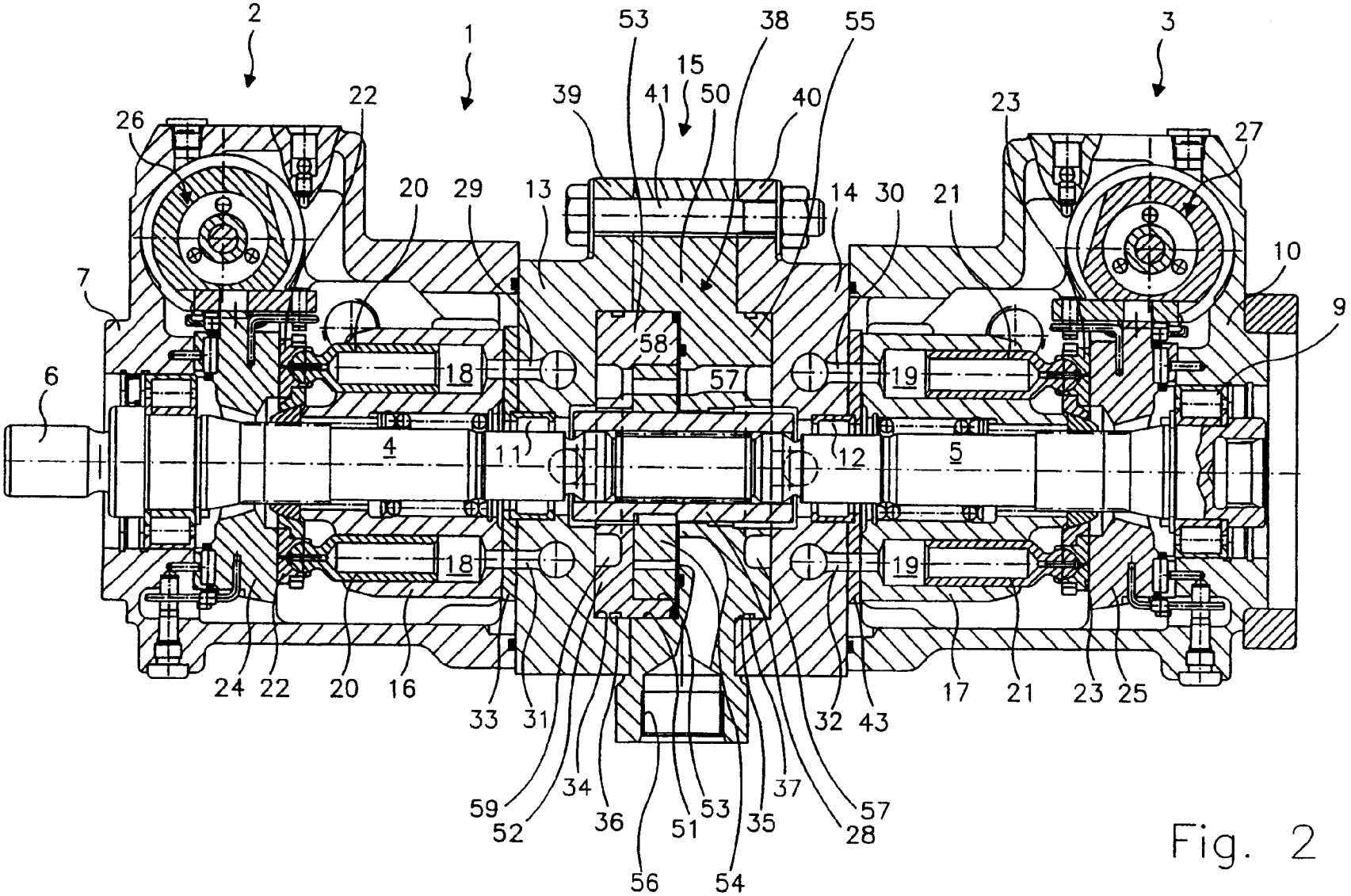
FIG. 2 is an axial section through an embodiment of the dual pump unit according to the invention in a second configuration.

FIG. 2 shows the embodiment already described on the basis of FIG. 1 in an axial longitudinal section according to a second configuration of the connecting piece 15.

In the configuration represented in FIG. 2 the connecting piece 15 consists of the connection plates 13 and 14, which are unchanged with respect to the configuration represented in FIG. 1, and an intermediate element 38, which is of a different configuration to that of FIG. 1. In the configuration represented in FIG. 2 the intermediate element 38 consists of a main body 50, an insert body 52, which is inserted in a recess 51 in the main body 50, and a booster pump 54, which is inserted in a recess 53 in the insert body 52. The booster pump 54 is formed as a gear pump of crescent design in the embodiment represented in FIG. 2. However it could also be formed with impellers like a turbine.

The main body 50 is provided with an axial projection 55 which in the embodiment is formed with a cylindrical outer contour and engages in the recess 35, likewise cylindrical, in the connection plate 14. The insert body 52 protrudes axially out of the main body 50. The portion of the insert body 52 protruding out of the main body 50 forms a second axial projection 53, which engages in the recess 34 in the connection plate 13. The recess 34 in the connection plate 14 is also cylindrical in the embodiment, with the recesses 34, 51 and 35 preferably having the same diameter.

Therefore, as in the configuration represented in FIG. 1, the connection plates 13 and 14 partly encompass the intermediate element 38 radially and the intermediate element 38 is fixed bet ween the connection plates 13 and 14. It is to be emphasized that the different configurations of the dual pump unit 1 do not require any adaptation of the connection plates 13 and 14 and the individual construction is restricted to a special configuration of the intermediate element 38. A dual pump unit 1 which has already been mounted can therefore also be immediately converted after loosening the screw connection 41. The expenditure for producing and mounting the components is extremely low, as most components can be used as standard for all configurations.

In the embodiment represented in FIG. 2 a low-pressure port 56, which is connected to the booster pump 54, is integrated into the main body 50. A connection 57 from the booster pump 54 to a first ring channel 57 adjoining the connection plate 14 is also provided in the main body 50. A connection 58 from the booster pump 54 to a second ring channel 59 adjoining the connection plate 13 is provided in the insert body 52. The ring channels 57 and 59 have the advantage that the connection with the respective low-pressure line 31 or 32 can be made at an appropriate point.

The connection plates 13 and 14 and the main body 50 of the intermediate element 38 are also screwed together by means of screws 41 at a region radially surrounding the insert body 52 in the configuration represented in FIG. 2.

The intermediate piece 38 is responsible both for centring and integrating the booster pump 54 in the configuration represented in FIG. 2. There is no need for expensive pipework for connecting the two hydraulic pumps 2 and 3 to the booster pump 54. The booster pump 54 may also be turned through 180° when mounted if the drive shafts 4 and 5 are driven in the opposite direction of rotation.

The invention is not restricted to the represented embodiment. For example, other booster pumps may also be used or additional functions integrated into the intermediate element 38. Control valves, pressure-relief valves and other hydraulic components may in particular be disposed in the intermediate element 38. The configuration according to the invention enables the connection of two hydraulic pumps 2 and 3 to be optimised in terms of cost and overall length.

What is claimed is:

1. Dual pump (1) with two hydraulic pumps (2, 3), the hydraulic pumps (2, 3) having cylinders (18, 19) for cyclical operation of the hydraulic pumps (2, 3), the hydraulic pumps (2, 3) having coaxially disposed drive shafts (4, 5), the coaxially disposed drive shafts (4, 5) being non-positively coupled together by means of a coupling piece (28), and a connecting piece (15) surrounding the coupling piece (28), such that high-pressure lines (29, 20) and low-pressure lines (31, 32) are formed in the connecting piece (15), the connecting piece (15) extending between two control bodies (33, 43) each associated with one of the hydraulic pumps (2, 3) and serving to cyclically connect the cylinders ( 18, 19) of the hydraulic pumps (2, 3) to the high-pressure lines (29, 30) and the low-pressure lines (31, 32), characterised in that the connecting piece (15) comprises two connection plates (13, 14), each connecting plate (13, 14) adjoining the control body (33, 43) associated with one of the hydraulic pumps (2, 3), and an intermediate element (38), which is disposed between the connection plates (13, 14), is interchangeable and configurable such that the connection plates (13, 14) each comprise a recess (34, 35) in which the intermediate element (38) is at least partly inserted such that the connection plates (13, 14) at least partly encompass the intermediate element (38) radially and the intermediate element (38) is fixed between the connection plates (13, 14).

2. Dual pump unit according to claim 1, characterised in that the intermediate element (38) is a discoid cylindrical body, the diameter of which substantially corresponds to the cylindrical recesses (34, 35) in the connection plates (13, 14).

3. Dual pump unit according to claim 2, characterised in that the connection plates (13, 14) radially encompass the intermediate element (38) completely, and the connection plates (13, 14) are joined together, by means of screws (41), in a region (39, 40) radially encompassing the intermediate element (38).

4. Dual pump unit according to claim 3, characterised in that the intermediate element (38) comprises at least one ring channel (42).

5. Dual pump unit according to claim 1, characterised in that the intermediate element (38) comprises a main body (50), an insert body (52), which is inserted in a 15 recess (51) in the main body (50), and a booster pump (54), which is inserted in a recess (54) in the insert body (52).

6. Dual pump unit according to claim 5, characterised in that the main body (50) comprises a first axial projection (55), which engages in the recess (35) in one of the two connection plates (14), and that the insert body (52) protrudes out of the recess (51) in the main body (50) and the portion of the insert body (52) protruding out of the main body (50) forms a second axial projection (59), which engages in the recess (34) in the other connection plate (13).

7. Dual pump unit according to claim 6, characterised in that the recesses (34, 35, 51) in the connection plates (13, 14) and the main body (55) are cylindrical and of the same diameter, wherein the insert body (52) is formed with cylindrical external dimensions.

8. Dual pump unit according to claims 5, characterised in that a low-pressure port (56) and a connection (57) from the booster pump (54) to a first ring channel (57), which adjoins one of the connection plates (14), is integrated into the main body (55), and a connection (58) from the booster pump (54) to a second ring channel (59), which adjoins the other connection plate (13), is integrated into the insert body (52).

9. Dual pump unit according to claim 5, characterised in that the connection plates (13, 14) and the main body (50) are joined together, by means of screws (41), in a region (39, 40) radially surrounding the insert body (52).

* * * * *